US005830000A

United States Patent [19]

Shifflett et al.

[11] Patent Number: 5,830,000

[45] Date of Patent: Nov. 3, 1998

[54] LOCKING LEVER CONNECTOR MECHANISM

[75] Inventors: Dennis Shifflett, Macomb; Yuqi Chen, Detroit, both of Mich.

[73] Assignee: TRW Inc., Cleveland, Ohio

[21] Appl. No.: 856,203

[22] Filed: May 14, 1997

[51] Int. Cl.[6] ..... H01R 13/627

[52] U.S. Cl. ..... 439/352; 439/357

[58] Field of Search ..... 439/350–355, 439/357, 358

[56] References Cited

U.S. PATENT DOCUMENTS

| | | | |
|---|---|---|---|
| 5,605,471 | 2/1997 | Plyeer | 439/352 |
| 5,630,727 | 5/1997 | Kamlyama | 439/352 |
| 5,722,849 | 3/1998 | Alunine | 439/352 |

*Primary Examiner*—Hien Vu
*Attorney, Agent, or Firm*—Fay, Sharpe, Beall, Fagan, Minnich & McKee

[57] ABSTRACT

An assembly of a first component and a second component joined by a locking lever connector mechanism includes a first component having an elongated guide rib extending outwardly thereof in a second direction. A flexible latch arm also extends outwardly from the second component at a location spaced from the guide rib to define a narrow slot extending in a first direction. The latch arm has a terminal end with a latch element extending therefrom in a direction laterally away from the slot. The first component has a catch element positioned to engage with the latch element when the first component and the second component are in an assembled relationship. The first component further includes a locking lever having a body portion extending from the first component into the slot to prevent movement of the latch arm laterally away from the catch element. A resilient portion is provided for permitting selective manual deflection of the locking lever out of the slot to permit lateral movement of latch arm away from the catch element to allow the first component and the second component to be disassembled.

9 Claims, 3 Drawing Sheets

LOCKING LEVER CONNECTOR MECHANISM

BACKGROUND OF THE INVENTION

The subject invention is directed toward the art of couplings and connectors and, more particularly, to a connector for releasably joining separate body components.

The invention is especially suited for use in connecting molded plastic housings of the type frequently used for various mechanical and electromechanical assemblies and will be described with reference thereto. However, the invention is capable of broader application and can be used for releasably connecting many types of devices and components thereof.

Housings for small mechanical and electromechanical assemblies should preferably be simple in design and easy to assemble without the use of fasteners requiring separate tools. In addition, it is often desirable that they be capable of being quickly opened for maintenance or repair of the internal mechanisms.

SUMMARY OF THE INVENTION

The subject invention provides a connector mechanism which includes a releasable latch arrangement that allow housings and various mechanical components to be rapidly connected and manually disconnected without the use of tools or separate fastener devices. The mechanism can be molded integrally with plastic components and can be incorporated directly in a variety of different structures. More particularly, in accordance with one aspect of the invention, a connector latch mechanism is provided for releasably joining a first component, such as a housing component, to a second component in assembled relationship. The mechanism comprising the second component includes an elongated guide rib extending outwardly thereof in a first direction. A flexible latch arm extends outwardly from the second component at a location spaced from the guide rib to define a narrow slot that extends in the first direction. The latch arm includes a terminal end with a latch element extending therefrom in a direction laterally away from the slot. The first component includes a catch element positioned to engage with the latch element when the first component and the second component are in assembled relationship. The first component further includes a locking lever having a body portion extending from the first component into the slot to prevent movement of the latch arm laterally away from the catch element. The locking lever includes a resilient portion for permitting selective deflection of the locking lever out of the slot to permit lateral movement of the latch arm away from the catch element to allow the first component and the second component to be disassembled.

Preferably, in accordance with a further aspect of the invention, the locking lever has an actuating portion that extends outwardly of the slot when the body portion is located in the slot.

In its preferred form, the latch arm includes an insert that is contoured to engage under the locking lever and deflect the locking lever outwardly during movement of the first and second components toward their assembled position. In addition, there are cooperating surfaces on the latch element and the catch element to produce lateral movement of the latch arm during movement of the first and second components toward their assembled position. Thus, the latch is deflected laterally simultaneously while the latch arm is moving the locking lever to an outer position during assembly. This arrangement thus requires no separate operation or manual movement of the latching elements by the assembler. That is, the first and second components are merely moved toward one another with the locking lever extending into the slot during the assembly movement. All movements of the latch arm and the locking lever are thus automatically produced by the cooperating surfaces.

As can be seen from the foregoing, the primary object of the invention is the provision of a simple and effective latch mechanism for releasably joining separate components in an assembled relationship.

A further object of the invention is the provision of a mechanism of the general type described which can be readily molded integrally with the components intended to be joined.

A still further object is a provision of a mechanism of the type described which does not require any particular manipulation of the various elements during the assembly operation.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
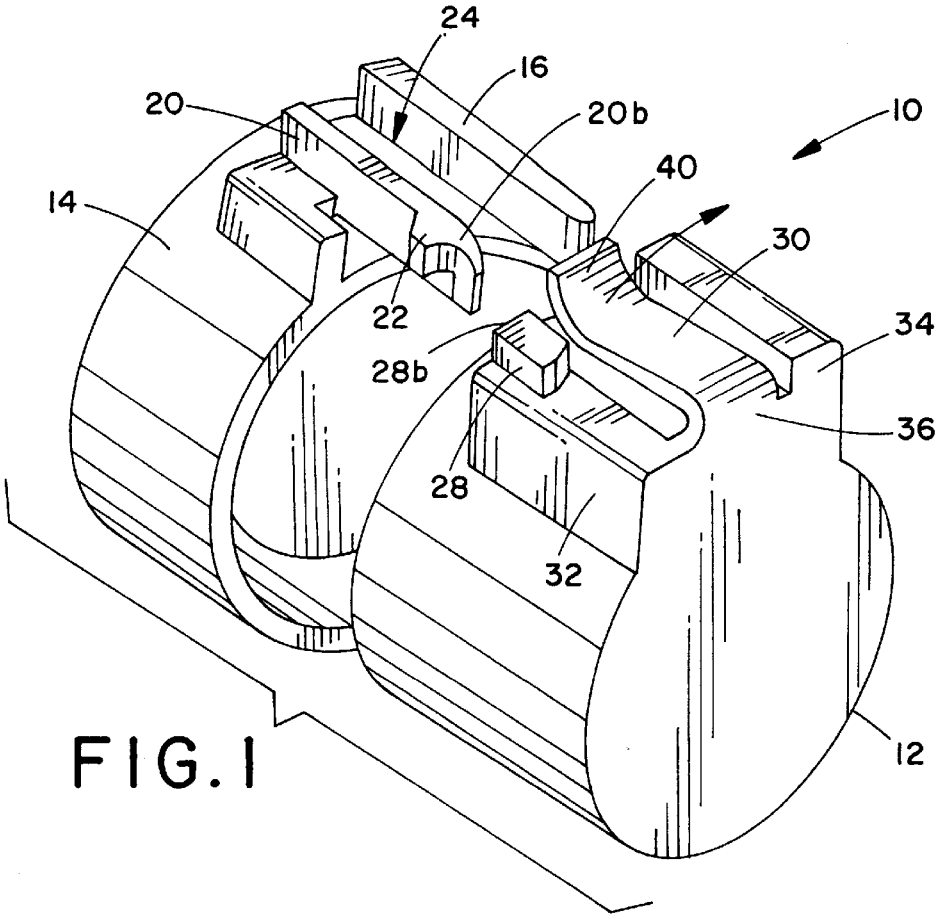
FIG. 1 is an isometric view of the two main components in aligned relationship prior to being moved to their assembled condition.
Figure 1A:
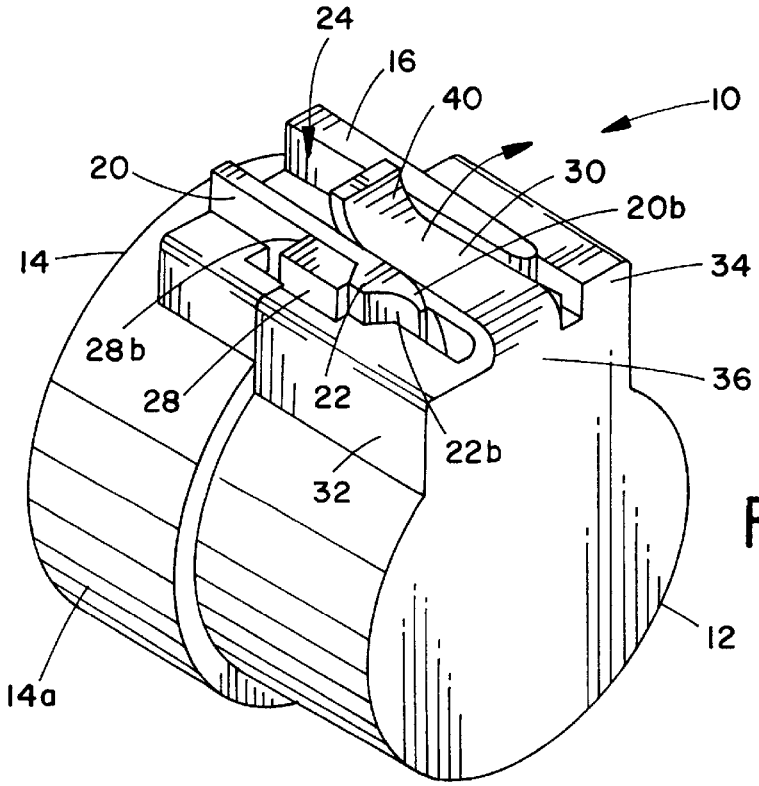
FIGS. 1A and 2 are isometric views looking at the right and left-hand ends, respectively, of the two main components after being joined in assembled condition by a connecting latch mechanism formed in accordance with the preferred embodiment of the subject invention.
Figure 2:
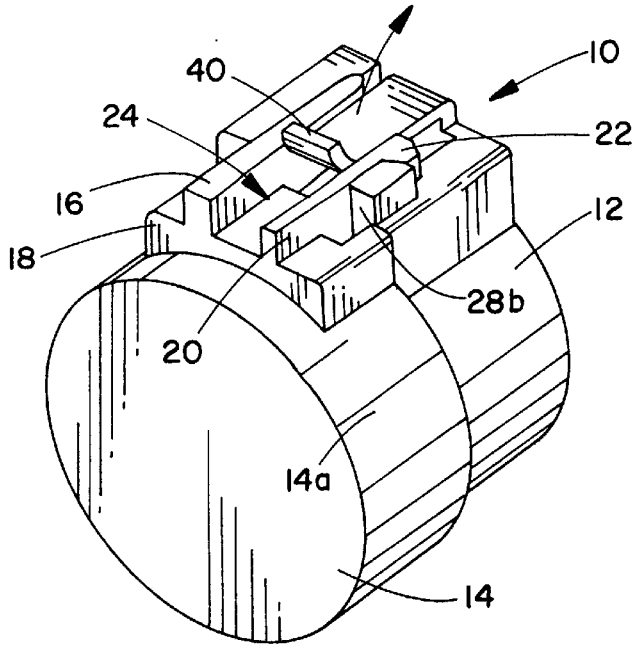

Referring now to the drawings wherein the showings are for the purposes of illustrating the preferred embodiment of the invention only and not for purposes of limiting same, FIGS. 1A and 2 best illustrate the overall arrangement of the connector latch assembly 10 being used to releasably connect a first main component 14 with a second main component 12. In the preferred embodiment, the components 12 and 14 are cooperating halves of a plastic housing or container which is intended to be used for control elements or the like. The particular size of the containing components 12 and 14 could vary widely and it should be appreciated that various other types of structures could be joined using the connector latch mechanism 10.

Figure 4:
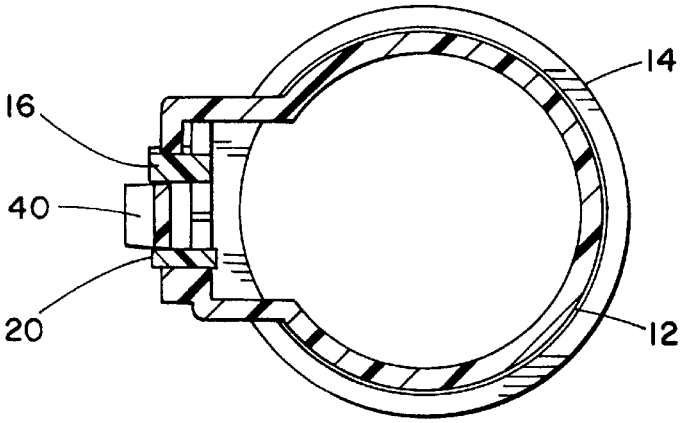
FIG. 4 is a cross-sectional view taken on line 4—4 of FIG. 3.
Figure 5:
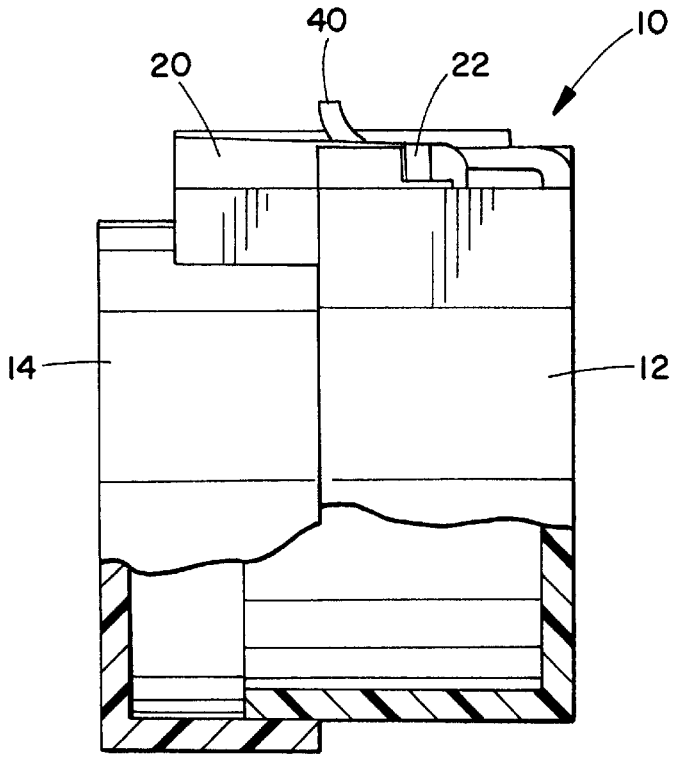
FIG. 5 is a side elevational view (partially in cross section) of the FIG. 3 showing; and, FIG. 6 is an end view looking toward the right-hand end of the FIG. 3 showing.
Figure 6:
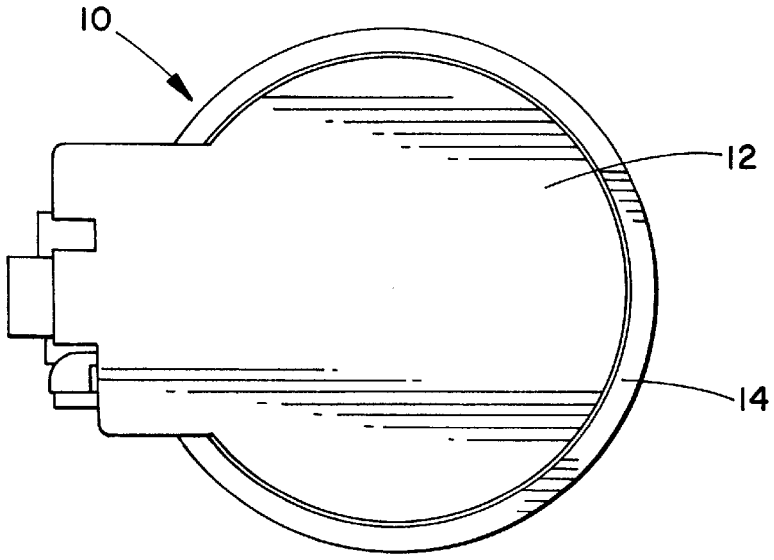

With particular reference to the illustrated components 12 and 14, it can be seen in FIGS. 4 and 5, for example, that they are in the shape of a generally cylindrical container sized so that the section 12 interfits within the section 14.

Referring more particularly to the connector latch mechanism 10, it will be seen that the mechanism includes an elongated guide rib member 16 that is preferably molded integrally with component 14 and extends outwardly thereof in a first direction. The guide rib 16 is carried on a base element 18 that extends outwardly from the cylindrical side wall surface 14*a* of component 14.

Figure 3:
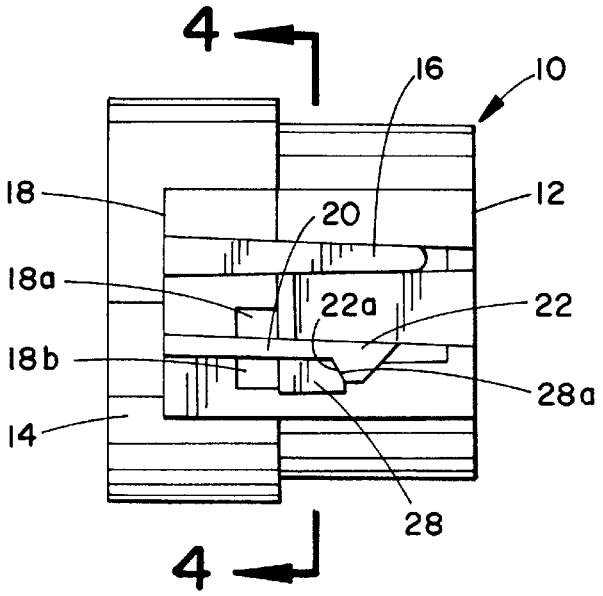
FIG. 3 is a top plan view of the assembled components shown in FIGS. 1A and 2.

Associated with the guide rib 16 and spaced laterally thereof is a flexible latch arm 20 having a laterally extending latch element 22 carried on the outer free end thereof. The latch arm 20 and its laterally extending latch element 22 will subsequently be described in greater detail, but for the present, it should be noted that the latch arm 20 is spaced from the guide rib 16 and defines a narrow slot 24. It should also be noted that the base 18 (see FIG. 3) is cut away at 18*a* and 18*b* to increase the lateral flexibility of the arm 20.

Arranged to cooperate with the latch arm 20 and the guide rib 16 are a latch element 28 and a locking lever 30 carried by the component 12. As shown, component 12 includes the outwardly extending base forming elements comprising spaced side walls 32 and 34 connected by a relatively thin end wall 36. The latch element 28 is carried at the top surface of the side wall 32 and extends upwardly therefrom. The latch element 28 is arranged such that when the components are moved to the assembled position of FIGS. 1 and 2, the element 22 engages behind the right-hand end (as viewed in FIG. 1A) of the latch 28. The engaging surfaces are inclined or angled as shown for reasons which will subsequently be described in some detail. In addition, it should be noted that the locking lever 30 extends laterally from the top of the end wall 36 and has a width to allow it to be closely but slidably received within the slot 24 as the components are axially together from the position of FIG. 1 toward the assembled position of FIG. 1A. Additionally, it should be noted that the locking lever 30 is designed so as to be capable of undergoing flexure in a direction radially outward from between latch arm 20 and the guide rib 16. However, when the parts are in the assembled position of FIGS. 1 and 2, the location of the locking lever 30 in the slot 24 prevents any lateral movement of the flexible latch arm 22. Thus, the components must remain in this latched position because of engagement between the latch element 22 and the catch element 28. However, when the locking lever is pivoted out of position from between the arm 20 and the guide rib 16, axial separation of components 12 and 14 can be accomplished since the latch arm 20 can pivot in a generally lateral direction into the slot 24 and move past the catch element 28. The lateral movement of the arm 20 is provided by the cooperating inclined surfaces best seen in FIG. 3. Note that catch element 28 has a tapered forward surface 28*a* that engages with the correspondingly tapered surface 22*a* of latch element 22.

To facilitate movement of the locking lever from its locked position shown in FIG. 1A to its released position, there is an operating portion 40 formed to extend outwardly from the main body of locking lever 30 to facilitate to gripping and outward deflection of the locking lever. The outward extension 40 can readily be seen in FIG. 5. After disassembly, reassembly can be accomplished merely by aligning the locking lever 30 with the slot 24 (see FIG. 1) and pushing the components 12 and 14 axially toward one another. During the assembly movement, the outer free end of the latch arm 22 engages under the operating portion 40 of the locking lever to cause it to deflect radially outward from its normal position within slot 24. For this reason, the forward end of the latch arm 20 is inclined or rounded as seen at 20*b* so that it will enter under the locking lever with greater ease. Simultaneously, engagement between the inclined surface 22*b* of the latch element with the rear wall 28*b* of the catch element 28 causes the latch arm to deflect in a direction into the slot 24. This deflection takes place simultaneously with the pivotal movement of latch arm 30 out of slot 24. However, as soon as the catch element 22 passes the catch element 28, it pivots back to its normal position as shown in FIG. 1A and thus engages behind the catch element. This allows the locking lever to move to its locked position shown in FIGS. 1 and 2. The movement of the latch arm and the locking lever takes place automatically merely by their described cooperation as the components 12 and 14 are pushed together. The disassembly, though, as previously discussed, requires a positive deflection of the locking lever 30 out of the slot 24.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. The combination comprising:

a first component having an elongated guide rib extending outwardly thereof along a first direction, a flexible latch arm extending outwardly from the first component at a location spaced from the guide rib to define a narrow slot extending in said first direction, said latch arm having a latch element extending therefrom in a direction laterally away from the slot, and, a second component having a catch element extending outwardly therefrom and positioned to engage with the latch element when the first component and the second component are in an assembled relationship, said second component further including a locking lever having a body portion extending from the second component into said slot when the first component and the second component are in said assembled relationship to selectively prevent lateral movement of the latch arm away from the catch element, said locking lever including a resilient portion for permitting selective deflection of said locking lever out of said slot to permit said lateral movement of said latch arm away from the catch element to allow relative movement between the first component and the second component when the first component and the second component are disassembled.

2. The combination as defined in claim 1 including an actuating portion on said locking lever, said actuating portion extending outwardly of said slot when said body portion is located in said slot.

3. The combination as defined in claim 1 wherein said body portion has a width substantially equal to the width of said slot.

4. The combination as defined in claim 1 wherein said second component includes a guide wall extending parallel to said locking lever and, in combination therewith, defining a recess that receives the guide rib when the first and second components are in said assembled relationship.

5. The combination as set forth in claim 4 wherein said first and second components are molded from plastic, and further wherein said latch arm is molded of plastic integrally with said first component and said locking lever is molded of plastic integrally with said second component.

6. The combination as set forth in claim 4 wherein the locking lever is of substantially uniform width throughout its length.

7. The combination of claim 1 wherein said latch arm includes an end surface contoured to engage under the locking lever and deflect the locking lever outwardly during movement of the first and second components toward said assembled relationship.

8. The combination of claim 7 including cooperating surface means on said latch element and said catch element to produce lateral movement of said latch arm during movement of the first and second components toward said assembled relationship.

9. The combination as defined in claim 8 wherein the latch arm is spaced a distance from the guide rib only slightly greater than the width of the locking lever.

* * * * *